US009357864B2

(12) United States Patent
Campagna

(10) Patent No.: US 9,357,864 B2
(45) Date of Patent: Jun. 7, 2016

(54) SPINAL ALIGNMENT PILLOW

(71) Applicant: Anthony Gino Campagna, Fremont, CA (US)

(72) Inventor: Anthony Gino Campagna, Fremont, CA (US)

( * ) Notice: Subject to any disclaimer, the term of this patent is extended or adjusted under 35 U.S.C. 154(b) by 172 days.

(21) Appl. No.: 14/042,309

(22) Filed: Sep. 30, 2013

(65) Prior Publication Data

US 2016/0000242 A1 Jan. 7, 2016

(51) Int. Cl.
*A47G 9/10* (2006.01)
*A61G 13/12* (2006.01)

(52) U.S. Cl.
CPC ..... *A47G 9/1054* (2013.01); *A47G 9/1063* (2013.01); *A61G 13/121* (2013.01); *A61G 13/122* (2013.01); *A47G 2009/1018* (2013.01)

(58) Field of Classification Search
CPC ..... A47G 9/10; A47G 9/1009; A47G 9/1027; A47G 9/1036; A47G 9/1045; A47G 9/1054; A47G 9/1063; A47G 9/1072; A47G 9/1081; A47G 9/109; A61G 13/1205; A61G 13/122; A61G 13/1225; A61G 13/123; A61G 7/07; A61G 7/1086; A61G 7/1088; A61G 7/109; A61G 7/1009; A61G 2005/122; A61G 2005/124
See application file for complete search history.

(56) References Cited

U.S. PATENT DOCUMENTS 3,828,377 A * 8/1974 Fary, Sr. ..... A47C 20/026 297/392
4,118,813 A * 10/1978 Armstrong ..... A61F 5/56 5/636
5,095,569 A * 3/1992 Glenn ..... A47G 9/0253 5/482
D404,237 S * 1/1999 Boyd ..... 5/636
6,226,818 B1 5/2001 Rudick
6,473,923 B1 11/2002 Straub
6,671,907 B1 1/2004 Zuberi
6,877,176 B2 * 4/2005 Houghteling ..... A47D 13/08 5/633
8,069,515 B1 * 12/2011 Tingey ..... A47C 20/023 5/632
8,161,588 B1 4/2012 Anson
9,131,792 B1 * 9/2015 Wagner ..... A47G 9/1063
2005/0229314 A1 * 10/2005 Chisari ..... A47C 20/026 5/632
2006/0253986 A1 * 11/2006 Rubio ..... A47G 9/10 5/632
2011/0083278 A1 4/2011 Muratalla
2013/0245395 A1 9/2013 Bidarian Moniri

* cited by examiner

*Primary Examiner* — David E Sosnowski
*Assistant Examiner* — Amanda L Miller
(74) *Attorney, Agent, or Firm* — GSS Law Group

(57) ABSTRACT

A pillow includes a torso cushion tapering from a top end to a bottom end. A torso support surface extends from the top end to the bottom end of the torso cushion. A back surface joins to the bottom end of the torso cushion at a first elevation angle between the back surface and the support surface. A head cushion attaches to the top end of the torso cushion. The head cushion includes a back surface joined to the back surface of the torso cushion, a first angled surface joined to the back surface of the head cushion at a second elevation angle, and a second angled surface joined to the back surface of the head cushion at a third elevation angle. The first angled surface and the second angled surface join to one another along a crest extending from the top end of said torso cushion.

19 Claims, 8 Drawing Sheets

Section B-B

Section C-C

Section D-D

SPINAL ALIGNMENT PILLOW

FIELD OF THE INVENTION

Embodiments of the invention are generally related to cushions for supporting a person's head and upper body and are related more specifically to pillows for preventing or correcting misalignment of vertebrae in a spinal column.

BACKGROUND

A conventional pillow may cause the vertebrae in the spine of a person sleeping face-down to become misaligned from their optimal positions. Misalignment of vertebrae may cause pain, damage to vertebrae, disks, muscles, and ligaments, and may limit a person's ability to move about freely. Sleeping face down on a conventional pillow may also lead to difficulty in breathing from obstruction of airflow by the pillow.

Sleeping on one's back may alleviate problems caused by twisting the neck and other parts of the spine while sleeping face down, but other breathing problems such as sleep apnea or snoring may be aggravated when a person's tongue or other soft tissues in the throat obstruct a person's airway. A person's health and well-being may depend on sleeping with the spinal column in optimal alignment and with airways unobstructed by a pillow or by the person's sleeping position.

SUMMARY

A pillow in accord with an embodiment of the invention includes a torso cushion tapering from a top end to a bottom end. The torso cushion includes a torso support surface extending from the top end to the bottom end of the torso cushion, a back surface joined to the bottom end of the torso cushion, and a first elevation angle between the back surface and the support surface of the torso cushion. The pillow further includes a head cushion attached to the top end of the torso cushion. The head cushion includes a back surface joined to the back surface of the torso cushion, a first angled surface joined to the back surface of the head cushion at a second elevation angle, and a second angled surface joined to the back surface of the head cushion at a third elevation angle. The first angled surface and the second angled surface join to one another along a crest extending from said top end of said torso cushion. The crest optionally extends from the top end of the torso cushion at the first elevation angle.

The pillow optionally includes a jaw support joined to the crest. A top surface of the jaw support may be parallel to the torso support surface. The jaw support may optionally have a triangular perimeter shape with an apex of the triangular perimeter shape aligned with the crest.

In some embodiments of the invention, the second elevation angle and the third elevation angle have different angular values. A selected one of either the second elevation angle or the third elevation angle may be a right angle. The crest may optionally be laterally offset from a longitudinal midline of the torso cushion.

The torso cushion may optionally be formed with a chin relief cutout in the torso support surface and the torso cushion top end. Either one or both of the head cushion and torso cushion may optionally be formed with a core comprising a first material and an outer layer comprising a second material. Either one or both of the head cushion and torso cushion may optionally be formed from a first layer comprising a first material and a second layer comprising a second material.

An embodiment of the invention may optionally include a torso insert, wherein the torso insert fits removably into a channel formed into the torso support surface. An additional plurality of torso inserts may optionally be included. Each of the additional plurality of torso inserts may be made from a material having a different compressibility and resilience than others of the additional plurality of torso inserts. The channel may optionally be sized for acceptance of more than one of the torso insert.

The torso support surface may optionally be formed with an aperture sized for admittance of a female breast. The pillow may optionally include an insert sized for fitting into the aperture.

DESCRIPTION

An embodiment of the invention, also referred to herein as a spinal alignment pillow, comprises at least two cushioning wedges joined together for supporting a person's head and upper body while the person is resting or sleeping in a reclining position. A spinal alignment pillow in accord with an embodiment of the invention encourages vertebrae in a person's spinal column to align with one another along a straight line when viewing toward the person's back. The spinal alignment pillow is adapted for a face-down sleeper who rests his or her chest and one side of the face against the pillow. Spinal alignment pillows may be manufactured in different sizes and materials to accommodate differences between users of the pillows, for example but not limited to, torso length, neck length, body weight, gender, and personal preferences or medical objectives for firmness of support.

While some people may find that a spinal alignment pillow is simply more comfortable than other pillows, embodiments of the invention may be beneficial for preventing, and possibly correcting, lateral displacements of the vertebrae in a human spinal column. Such lateral displacements may be painful and may be related to sore neck and back muscles, impaired range of motion for the spine or other parts of the body, compressed vertebrae, damaged disks, and other health problems. Preventing lateral displacements of the spinal column, that is, urging the spinal column to maintain an optimal aligned condition, may have other benefits for health and well-being. For example, people who suffer from sleep apnea or snoring may experience difficulty in breathing when a sleeping person's tongue slips into the back of the throat and obstructs the airway. However, when a person sleeps face down, gravity may pull the tongue away from the airway and make breathing easier and quieter. A spinal alignment pillow offers a nonsurgical solution to reducing airway obstruction while the person is sleeping by encouraging face-down sleeping.

Figure 1:
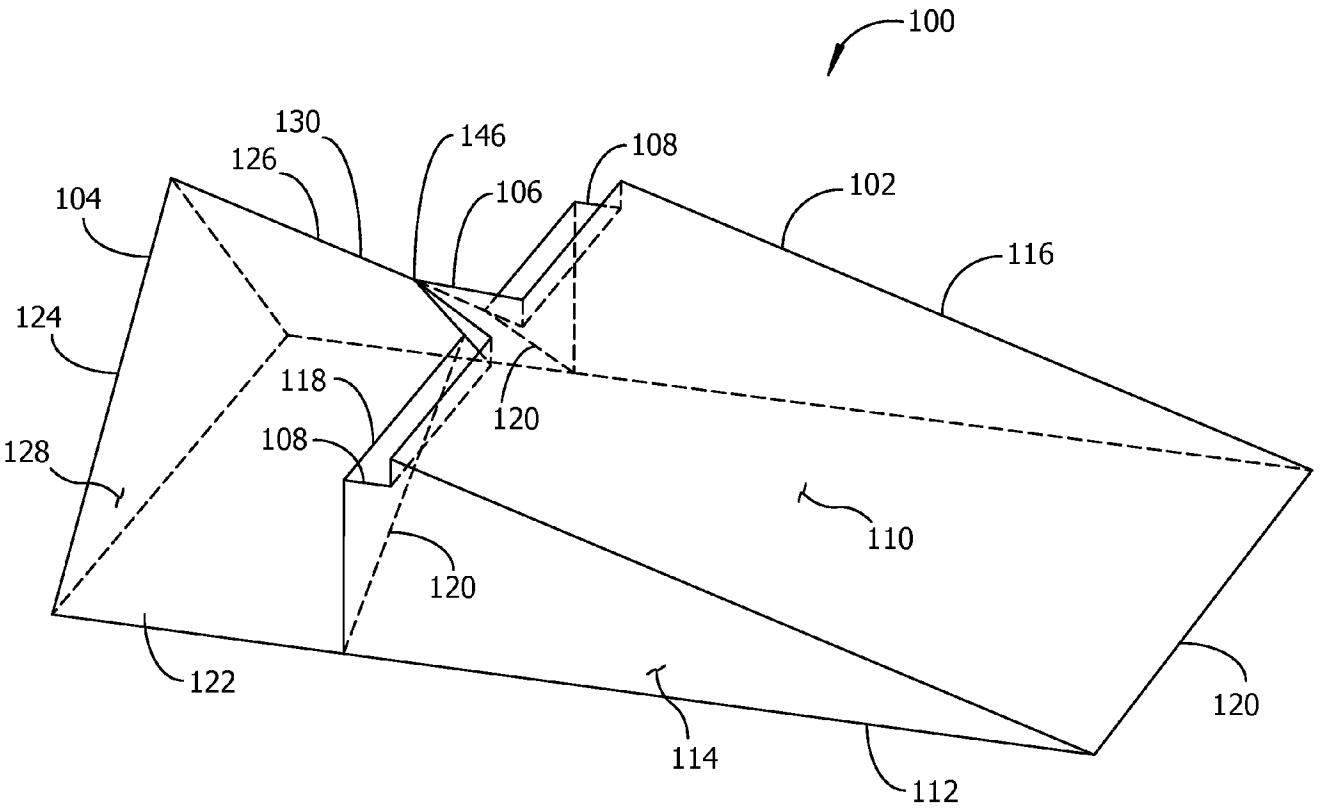
FIG. 1 shows a pictorial view toward the bottom end, left side, and front side of an example of an embodiment of the invention.

Turning now to the figures, an example of an embodiment of the invention 100 appears in FIG. 1, which shows a pictorial view of a spinal alignment pillow 100 toward the top end, left side, and front side of the pillow. The spinal alignment pillow includes a torso cushion 102 joined to a head cushion 104. The torso cushion 102 has a front side 110, also referred to as a torso support surface 110, joined to a left side 114 and to a right side 116 opposite the left side 114 (upper edge of right side 116 visible in FIG. 1). The torso cushion 102 is thickest at its top end 118 and tapers to a thinnest dimension at its bottom end 120. One or more optional chin relief cutouts 108 may be formed along the top end 118 of the torso cushion 102.

Figure 2:
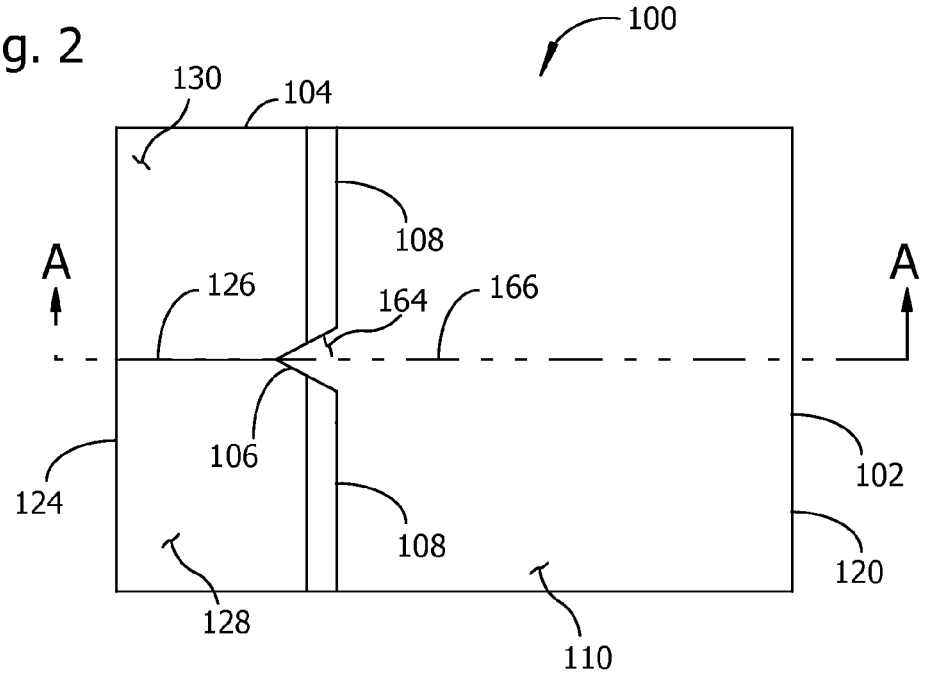
FIG. 2 is a view toward the front side of the example of FIG. 1.
Figure 3:
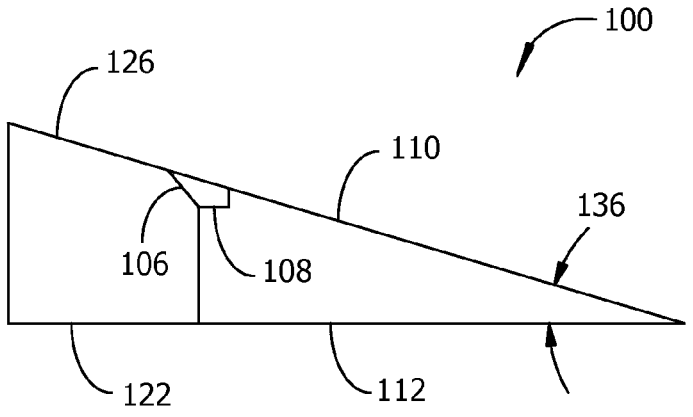
FIG. 3 is a view toward the left side of the example of FIG. 1.

An edge of the top end 124 of the head cushion 104 is visible in FIG. 1. The head cushion 104 is attached to the top end 118 of the torso cushion 102 on the bottom end 120 of the head cushion (bottom end 120 of head cushion marked by hidden lines in FIG. 1). The head cushion 104 includes a first angled surface 128 joined to a second angled surface 130 along a crest 126. An optional jaw support 106 is attached to, or alternately formed as an integral part of, the head cushion 104 with an apex 146 of the jaw support 106 centered above the crest 126 of the head cushion 104. The top surface 164 (ref. FIGS. 2-3) of the jaw support 146 may optionally be parallel to the torso support surface 110 of the torso cushion 102. The jaw support 146 may optionally be provided as a detachable component and may be provided in different sizes, shapes, and degrees of compressibility and resilience to accommodate the needs or preferences of a user of the spinal alignment pillow 100.

A person may use a spinal alignment pillow by lying on the pillow with his or her chest against the torso support surface on the torso cushion. One side of the person's face rests against either the first angled surface or the second angled surface on the head cushion. For example, a person may lie with a side of his or her face against the first angled surface on the head cushion. In embodiments of the invention including a jaw support, the person may rest his or her jaw against the jaw support. The jaw support may reduce displacements of the jaw during sleeping and may provide relief from medical conditions such as temporomandibular joint disorders (TMJ). On some embodiments of the invention, a person may alternately lie with the opposite side of his or her face against the second angled surface on the head cushion. Lying on the torso support surface with one side of the face against one of the angled surfaces on the head cushion urges the cervical and thoracic vertebrae into alignment, reducing stress on the spinal column and possibly reducing pain or damage to the vertebrae, disks, muscles, and ligaments of the spinal column.

The head cushion may 104 may be removably attachable to the torso cushion 102, for example by snaps, buttons, zippers, clasps, strips or patches of hook-and-loop fastener material, or other attachment means positioned so as not to cause discomfort to a person resting against the pillow. Alternatively, the head cushion 118 may be permanently joined to the torso cushion 102 by adhesive or fusing, or the head cushion and torso cushion may be formed as one integral structure as suggested in the example of FIG. 1, where the back surface of the torso cushion and the back surface of the head cushion form one planar surface.

The support surface 110 for the torso cushion 102, the head cushion first angled surface 128, and the head cushion second angled surface 130 may all be made with a smooth surface. Alternatively, these surfaces may be made with projections or surface relief, for example but not limited to, ribs, dimples, rounded projections, or textures. Different parts of a spinal alignment pillow may be made with different forms of surface relief or projections.

A view toward the front side 110 of the example of a spinal alignment pillow 100 from FIG. 1 is shown in FIG. 2. The support surface 110 of the torso cushion 102 has a rectangular perimeter shape in the example of FIG. 2. The support surface 100 may alternatively be formed with other polygonal or curved shapes, for example but not limited to, shapes with at least three sides, shapes with convex or concave curved sides, shapes with ribbed or undulating sides, aesthetically appealing decorative shapes, and so on. In the example of FIG. 2, the crest 126 of the head cushion 104 is approximately centered on the longitudinal midline 166 of the torso cushion 102.

FIG. 3 shows a view toward the left side of the example of a spinal alignment pillow 100 from FIGS. 1-2. The crest 126 of the head cushion 104 is approximately coplanar with the torso support surface 110 of the torso cushion 102 (crest and support surface both seen edge-on in FIG. 3). In some embodiments of the invention, the crest projects outward from the torso cushion at approximately the same angle as the elevation angle 136 between the support surface 110 and the back surface 112 of the torso cushion. In alternative embodiments of the invention, the elevation angle of the crest may differ from the elevation angle of the support surface on the torso cushion.

As an example, a spinal alignment pillow may have an overall length of about 32 inches from the bottom end of the torso cushion to the top end of the head cushion. The head cushion may have an overall width of about 22 inches, measured laterally across the back surface of the head cushion. The maximum thickness of the head cushion, measured from the back surface of the head cushion to the end of the crest at the top end of the cushion, is about 9.5 inches. The jaw support may be about 3 inches wide where it joins to the top end of the torso cushion, and the cutout for chin relief may be about 5 inches away from the apex of the jaw support's apex. In this example, the elevation angle for the first angled surface on the head cushion is about 23°. The elevation angle for the second angled surface on the head cushion is optionally the same as the elevation angle for the first angled surface. In this example, the elevation angle for the torso support surface is about 17°. A spinal alignment pillows may have any one or more of these dimensions and angles altered to suit the needs or preferences of a user of the pillow.

Figure 4:
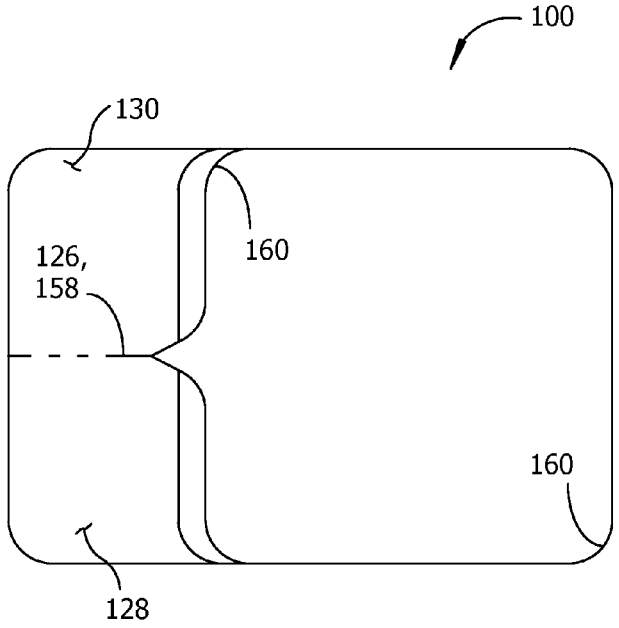
FIG. 4 is a view toward the front side of an alternative embodiment of a spinal alignment pillow having a head cushion with nonplanar faces, rounded edges, and rounded corners.

In the examples of FIGS. 1-3, the spinal alignment pillow 100 is drawn with distinct edges and corners to emphasize the shapes and angles of the various surfaces. In alternative embodiments of the invention, the edges and corners may be rounded as suggested in the example of FIG. 4. FIG. 4 shows a view toward the front side of an example of a spinal alignment pillow 100 having rounded corners 160 and one or more rounded edges 158, represented by a broken line to indicated rounding of the crest 126 of the head cushion. Other edges and corners may optionally be rounded.

Figure 5:
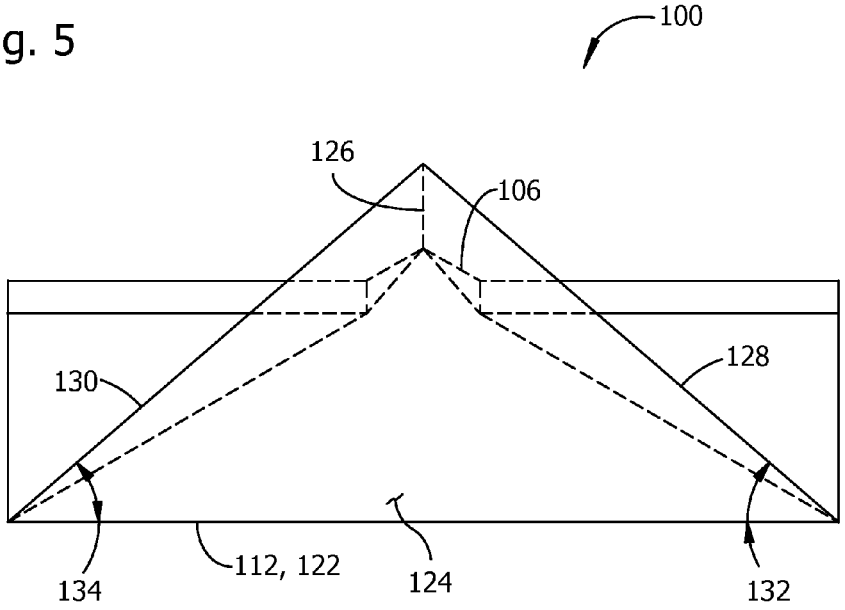
FIG. 5 is a view toward the top end of the example of FIG. 1.
Figure 6:
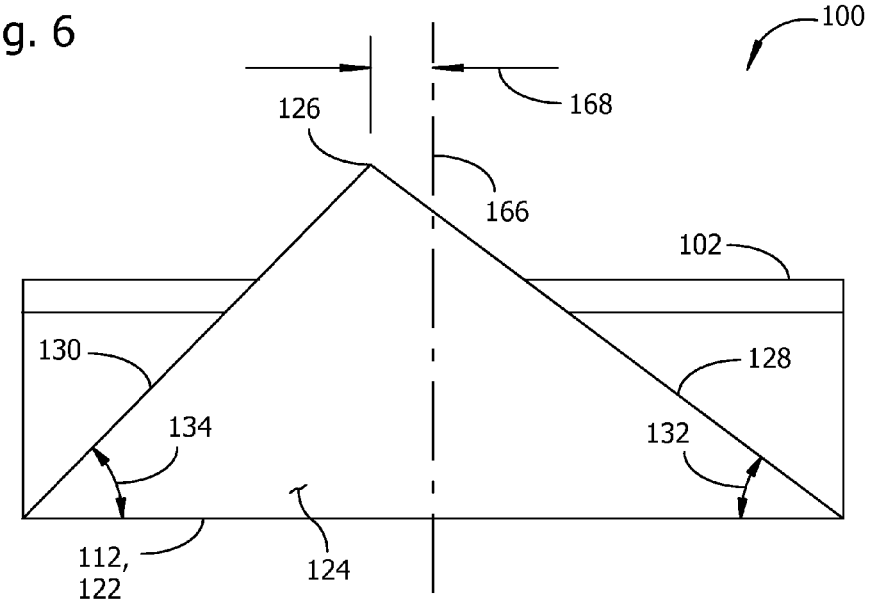
FIG. 6 is a view toward the top end of an alternative embodiment of a spinal alignment pillow having different elevation angles for the first and second angled surfaces on the head cushion and a crest displaced laterally from the longitudinal midline of the torso cushion.
Figure 7:
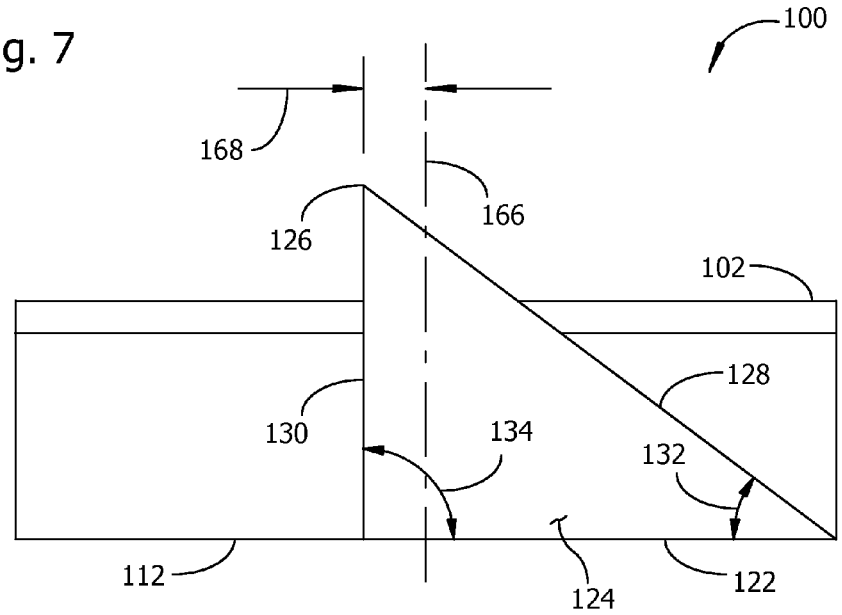
FIG. 7 is a view toward the top end of an alternative embodiment of the invention having a head cushion with an angled surface at a right angle to the bottom surface of the pillow.

A view toward the top end of the example of a spinal alignment pillow from FIGS. 1-3 is shown in FIG. 5. FIG. 5 shows an example of a first elevation angle 132 between the back surface 122 of the head cushion 104 and the first angled surface 128 (back surface seen edge-on in FIG. 4). FIG. 5 further shows the location of a second elevation angle 134 between the back surface 122 and the second angled surface 130. In the example of FIG. 5, the first and second elevation angles (132, 134) have approximately equal angular values. In the example of an alternative embodiment of the invention in FIG. 6, the elevation angles for the first and second angled surfaces on the head cushion have angular values which are substantially different from one another. Different elevation angles (132, 134) may be incorporated into an embodiment of the invention according to the medical needs or personal preferences of a user of the pillow. In some embodiments of the invention, the crest 126 of the head cushion 104 may be laterally displaced from the longitudinal midline 166 of the torso cushion 102, as suggested in the example of FIG. 6. Lateral displacement 168 of the crest 126 may optionally be combined with differing first and second elevation angles (132, 134) to apply a restorative force to a spine that is curved away from an optimal aligned condition. In some embodiments of the invention 100, one of the elevation angles on the head cushion 104 may be approximately 90 degrees to encourage a user of the pillow 100 to sleep with the head turned to the same side whenever the pillow is used. In the example of FIG. 7, the elevation angle 134 for the second angled surface 130 is approximately 90 degrees relative to the head cushion back surface 122.

Figure 8:
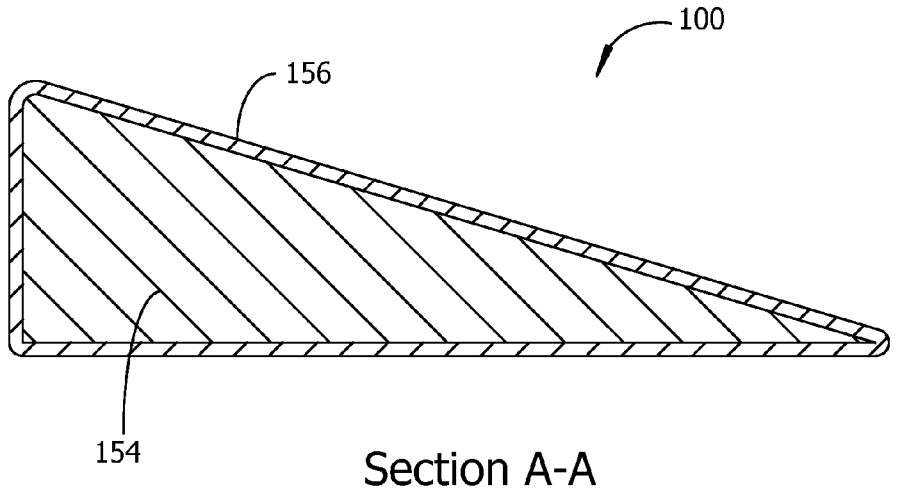
FIG. 8 is a cross-sectional view A-A of an embodiment of the invention having an inner core comprising cushioning material and an outer layer made from a different material than the core.

FIG. 8 shows a cross-sectional view A-A of the example of FIGS. 1-3. A position and viewing direction for section A-A is marked in FIG. 2. As suggested in FIG. 8, the head cushion and torso cushion may be made from a same material. The head cushion 104 and torso cushion 102 may alternatively be made from materials having different compressibility and resilience. In the example of FIG. 8, the head cushion 104 is formed with a core 154. The core 154 is surrounded by an outer layer 156. The core 154 and outer layer 156 may differ in, for example but not limited to, resilience, compressibility, ability to absorb or repel water, resistance to cleaning products, ease of sterilization, resistance to retaining odor, and so on. FIG. 8 is further representative of an alternative embodiment of the invention in which the outer layer 156 encloses a core 154 comprising a loose material such as sand, buckwheat (soba) grains, plastic pellets, and so on.

Figure 9:
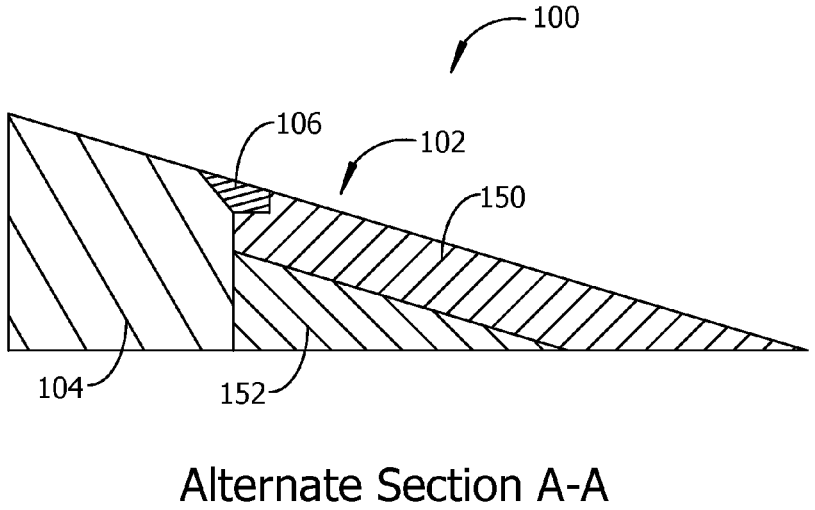
FIG. 9 is an alternative cross-sectional view A-A of another embodiment of the invention having multiple layers of cushioning material.

FIG. 9 shows an alternate cross sectional view A-A in which the torso cushion 102 is made from layers of different materials, for example a first layer 150 and a second layer 152. Embodiments of the invention may optionally include more than two layers. The torso cushion 102 may similarly be made from layered materials, or the torso cushion may be made from a core and outer layer as previously described for the head cushion.

Figure 10:
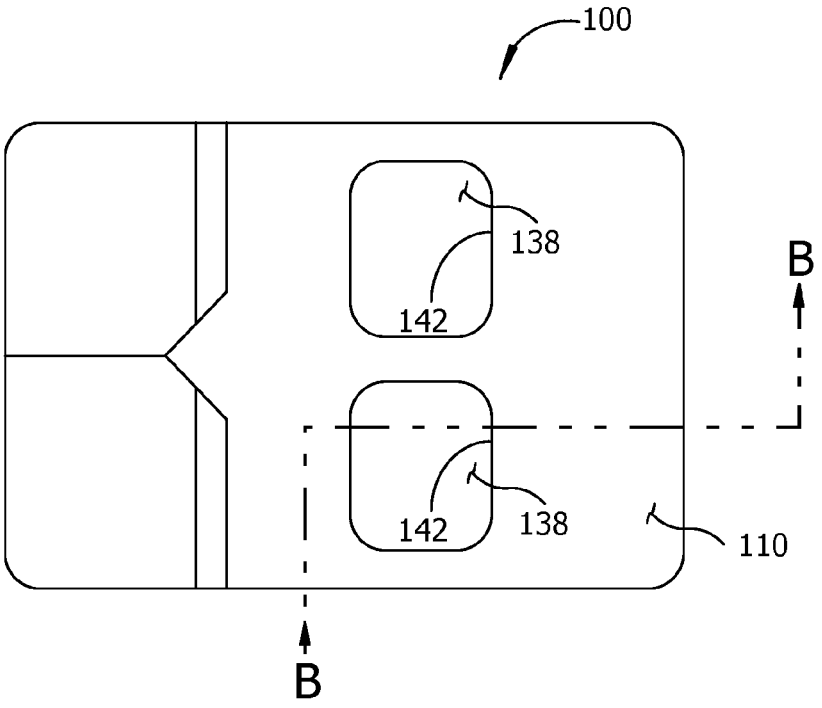
FIG. 10 is a view toward the front side of an alternative embodiment of the invention having two apertures with optional inserts for relieving pressure applied against a person's chest.
Figure 11:
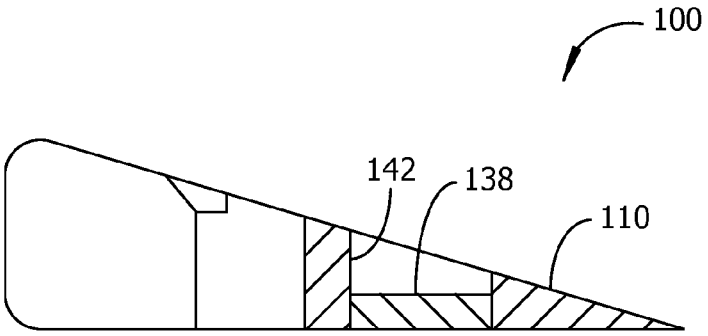
FIG. 11 is a cross sectional view B-B of the example of FIG. 10, showing an example of an insert for reducing a depth of an aperture formed in the torso cushion.

Some embodiments of a spinal alignment pillow may be formed with channels, apertures, or inserts to modify an amount of pressure exerted by the pillow against a user's body. In the example of FIG. 10, the support surface 110 of the torso cushion 102 is formed with an aperture 142 sized for admittance of a female breast. The pillow 100 of FIG. 10 may be more comfortable for use by a woman who has had breast surgery than a pillow with a flat support surface. More than one aperture 142 may optionally be formed in the pillow 100, or alternately an insert 138 may be placed in the aperture 142 to reduce the length, width, or depth of part of the aperture or of the entire aperture. FIG. 11 shows a cross-sectional view B-B of an example of an insert 138 used to reduce a depth of an aperture 142.

Figure 12:
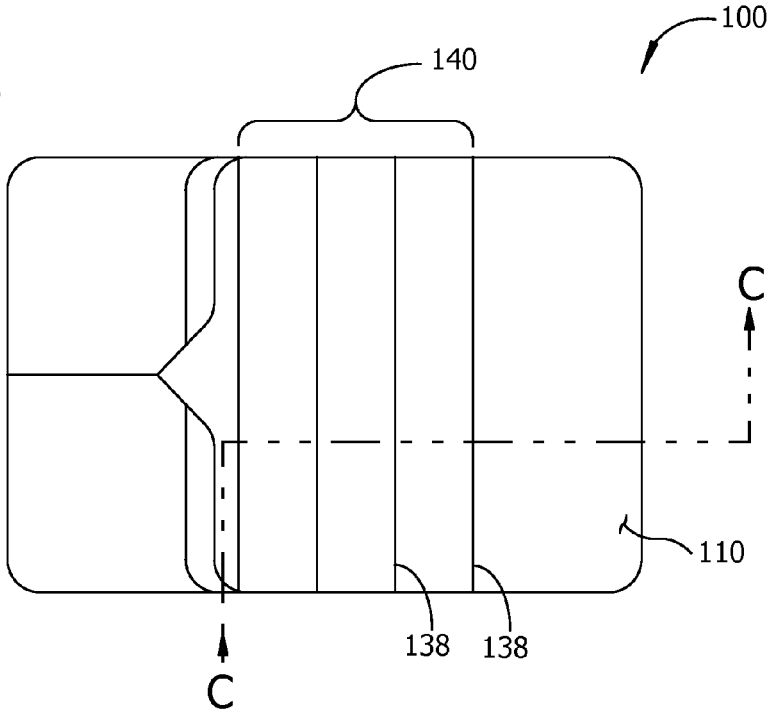
FIG. 12 is a view toward the front side of a torso cushion having a channel and one or more optional inserts for modifying an amount of pressure exerted by the pillow against a person's body.
Figure 13:
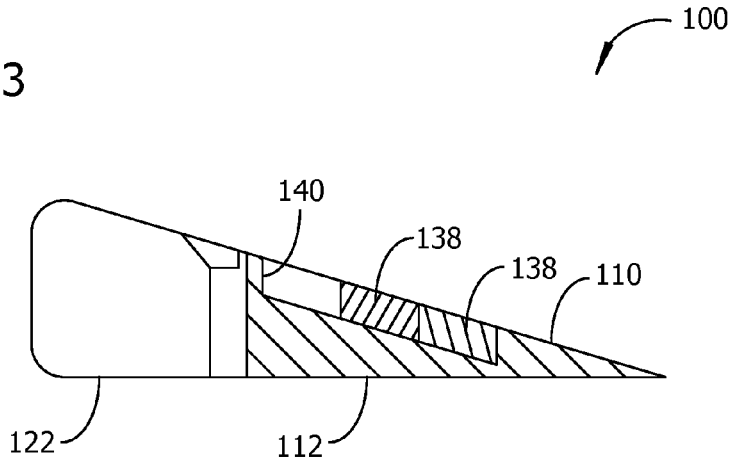
FIG. 13 is a cross-sectional view C-C of the example of FIG. 12.

A spinal alignment pillow 100 may alternatively be formed with a channel instead of an aperture for modifying an amount of pressure applied by the pillow to part of a person's body. In the example of FIG. 12, a torso cushion 102 is formed with a channel 140 into which at least one insert 138 may be placed. The example of a spinal alignment pillow from FIG. 12 is shown in cross-sectional view C-C in FIG. 13. An insert 138 may alternatively be sized to completely fill the channel, to partially fill the channel so that the part of the channel between the insert and the support surface of the torso cushion remains empty, or to extend outward from the support surface 110 of the torso cushion 102. An insert may have different thicknesses along its length or width to modify an amount of pressure exerted by the pillow against a user's body. An embodiment of the invention may optionally be formed with more than one channel. A channel may optionally be sized to accept more than one insert. Inserts may optionally be provided with different compressibility and resilience.

Figure 14:
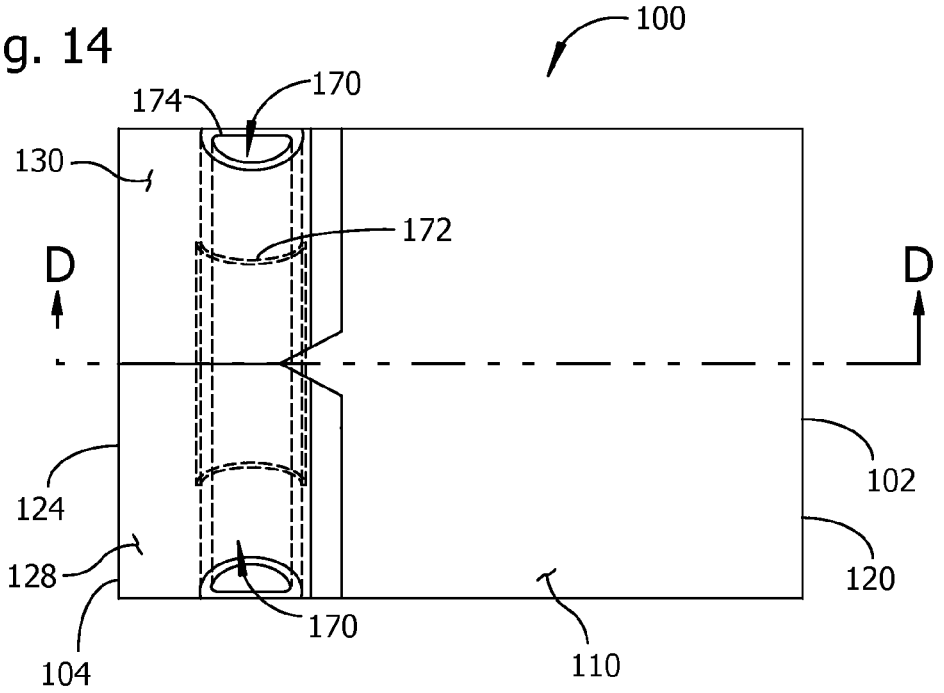
FIG. 14 is a view toward the front side of an example of another embodiment of the invention having a padded and reinforced transverse aperture formed laterally through the pillow.
Figure 15:
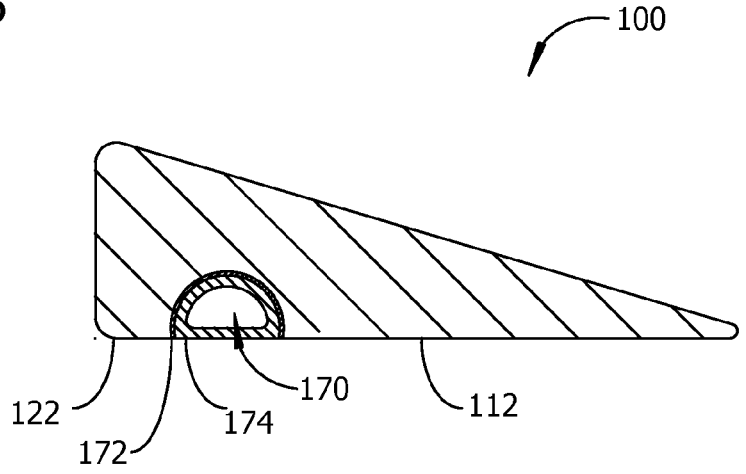
FIG. 15 is a cross-sectional view D-D of the example of FIG. 14.

A person resting or sleeping face-down may prefer to place his between his face and the bed upon which he rests. However, the weight of the person's head and upper body resting on his arms or hands may interfere with blood circulation, possibly leading to discomfort or health problems related to poor blood circulation. Some embodiments of the invention may therefore optionally provide space for a sleeper's arms and hands to prevent discomfort and circulatory problems. In the example of a spinal alignment pillow 100 in FIG. 14, a compression relief aperture 170 is formed laterally through the first and second angled surfaces ((128, 130) in the head cushion 104. The compression relief aperture is preferably sized for easy admittance of a human hand. An example of a location for the aperture 170 is shown in the cross-sectional view D-D in FIG. 15. An optional arcuate structural support 172 partially surrounds the compression relief aperture 170, preventing the compression relief aperture 170 from collapsing onto the hands and arms of a person sleeping face-down on the pillow 100. The compression relief aperture 170 may optionally be lined with padding 174 to prevent a person's hands and arms from uncomfortable contact with the structural support 172. While FIG. 14 shows the compression relief aperture 170 in the head cushion 104, the compression relief aperture may alternatively be formed in the torso cushion 102, or more than one compression relief aperture may be provided.

Unless expressly stated otherwise herein, ordinary terms have their corresponding ordinary meanings within the respective contexts of their presentations, and ordinary terms of art have their corresponding regular meanings.

What is claimed is:

1. A pillow, comprising:

a torso cushion tapering from a top end to a bottom end, comprising a torso support surface extending from said bottom end toward said top end of said torso cushion at a first elevation angle between a back surface and said torso support surface;

a head cushion attached to said back surface and to said top end of said torso cushion, comprising:

a top end of said head cushion attached to said back surface;

a first angled surface attached to said top end of said head cushion, said first angled surface joined to said back surface at a second elevation angle between said back surface and said first angled surface; and a second angled surface attached to said top end of said head cushion, an edge of said second angled surface directly joined to an edge of said first angled surface extending longitudinally from said top end of said head cushion to said torso support surface, said top end of said head cushion separated from said top end of said torso cushion by said first angled surface and said second angled surface, and said second angled surface joined to said back surface at a third elevation angle between said back surface and said second angled surface.

2. The pillow of claim 1, wherein said edge of said first angled surface and said edge of said second angled surface extends from said torso cushion at said first elevation angle.

3. The pillow of claim 1, further comprising a jaw support having a top surface extending from said torso support surface toward said top end of said head cushion, said top surface of said jaw support formed with an apex dispositioned between said top end of said torso cushion and said top end of said head cushion on said edge of said first angled surfaced.

4. The pillow of claim 3, wherein said top surface of said jaw support extends from said torso support surface at said first elevation angle.

5. The pillow of claim 3, wherein said jaw support has a triangular perimeter shape.

6. The pillow of claim 1, wherein said second elevation angle and said third elevation angle have different angular values.

7. The pillow of claim 1, wherein said second elevation angle is a right angle.

8. The pillow of claim 1, wherein said third elevation angle is a right angle.

9. The pillow of claim 1, wherein said edge of said second angled surface and said edge of said first angled surface are directly joined at a position is laterally offset from a longitudinal midline of said torso cushion.

10. The pillow of claim 1, wherein said torso cushion is formed with a chin relief cutout extending transversely across said top end of said torso cushion and said torso support surface from said jaw support to a first side of said torso cushion.

11. The pillow of claim 1, wherein said torso cushion comprises a first side joined to said torso support surface, said first side joined to said back surface, and a second side joined to said torso support surface opposite said first side, said second side joined to said back surface, said first side extending from said torso cushion bottom end to said torso cushion top end, said second side extending from said torso cushion bottom end to said torso cushion top end, said first angled surface separating said first side from said top end of said head cushion, and said second angled surface separating said second side from said top end of said head cushion.

12. The pillow of claim 1, wherein said head cushion is formed with a core comprising a first material and an outer layer comprising a second material.

13. The pillow of claim 1, wherein said head cushion is formed from a first layer comprising a first material and a second layer comprising a second material.

14. The pillow of claim 1, wherein said torso cushion is formed with a core comprising a first material and an outer layer comprising a second material.

15. The pillow of claim 1, wherein said torso cushion is formed with a first layer comprising a first material and a second layer comprising a second material.

16. The pillow of claim 1, further comprising a torso insert, wherein said torso insert fits removably into a channel formed into said torso support surface.

17. The pillow of claim 16, further comprising an additional plurality of torso inserts, wherein each of said additional plurality of torso inserts is made from a material having a different compressibility and resilience than others of said additional plurality of torso inserts.

18. The pillow of claim 16, wherein said channel is sized for acceptance of more than one of said torso insert.

19. The pillow of claim 10, wherein said torso cushion is formed with a second chin relief cutout extending transversely across said top end of said torso cushion and said torso support surface from said jaw support to a second side of said torso cushion.

* * * * *